United States Patent [19]

Lieberman

[11] Patent Number: 4,858,529

[45] Date of Patent: Aug. 22, 1989

[54] SPARK-SAFE LOW-VOLTAGE DETONATOR

[75] Inventor: Morton L. Lieberman, Albuquerque, N. Mex.

[73] Assignee: The United States of America as represented by the Department of Energy, Washington, D.C.

[21] Appl. No.: 214,370

[22] Filed: Jul. 1, 1988

[51] Int. Cl.[4] ..... F42C 19/12; F42B 3/12

[52] U.S. Cl. ..... 102/202.5

[58] Field of Search ..... 102/202.1, 202.5, 202.7, 102/202.8, 202.14, 204, 205

[56] References Cited

U.S. PATENT DOCUMENTS

| | | | |
|---|---|---|---|
| 3,186,341 | 6/1965 | Bjorklund et al. | 102/86.5 |
| 3,208,379 | 9/1965 | McKee et al. | 102/28 |
| 3,257,946 | 6/1966 | Tognola | 102/28 |
| 3,264,988 | 8/1966 | Rucker | 102/28 |
| 3,277,824 | 10/1966 | Bankston | 102/28 |
| 3,324,793 | 6/1967 | Thomas | 102/28 |
| 3,726,217 | 4/1973 | Dedman et al. | 102/28 R |
| 3,978,791 | 9/1976 | Lemloy et al. | 102/202.5 |
| 4,144,814 | 3/1979 | Day et al. | 102/202.5 |
| 4,517,895 | 5/1985 | Rucker | 102/202.2 |

*Primary Examiner*—Charles T. Jordan

*Attorney, Agent, or Firm*—Armand McMillan; James H. Chafin; Judson R. Hightower

[57] ABSTRACT

A column of explosive in a low-voltage detonator which makes it spark-safe includes an organic secondary explosive charge of HMX in the form of a thin pad disposed in a bore of a housing of the detonator in an ignition region of the explosive column and adjacent to an electrical ignition device at one end of the bore. The pad of secondary charge has an axial thickness within the range of twenty to thirty percent of its diameter. The explosive column also includes a first explosive charge of CP disposed in the housing bore in the ignition region of the explosive column next to the secondary charge pad on a side opposite from the ignition device. The first CP charge is loaded under sufficient pressure, 25 to 40 kpsi, to provide mechanical confinement of the pad of secondary charge and physical coupling thereof with the ignition device. The explosive column further includes a second explosive charge of CP disposed in the housing bore in a transition region of the explosive column next to the first CP charge on a side opposite from the pad of secondary charge. The second CP charge is loaded under sufficient pressure, about 10 kpsi, to allow occurrence of DDT. The first explosive CP charge has an axial thickness within the range of twenty to thirty percent of its diameter, whereas the second explosive CP charge contains a series of increments (nominally 4) each of which has an axial thickness-to-diameter ratio of one to two.

15 Claims, 1 Drawing Sheet

SPARK-SAFE LOW-VOLTAGE DETONATOR

RIGHTS TO INVENTION

The U.S. Government has rights in this invention pursuant to Contract No. DE-AC04-76DP00789 between the U.S. Department of Energy and AT&T Technologies, Inc.

CROSS REFERENCE TO RELATED APPLICATION

Reference is hereby made to the following copending application dealing with related subject matter and assigned to the assignee of the present invention: "Bonfire-Safe Low-Voltage Detonator" by Morton L. Lieberman, assigned U.S. Ser. No. 214,369 and filed July 1, 1988.

BACKGROUND OF THE INVENTION

1. Field of the Invention

The present invention relates generally to explosive detonators and, more particularly, is concerned with a low-voltage detonator providing improved electrostatic discharge, or spark, safety.

2. Description of the Prior Art

Reliable low-voltage detonators are typically loaded either with primary explosives, commonly lead azide and/or lead styphnate, or more recently with CP (2-(5-cyanotetrazolato) pentaamminecobalt (III) perchlorate) because it provides some safety advantages over the previously-used primary explosives. However, detonators containing CP or primary explosives adjacent to an electrical ignition device, such as bridgewire, lack intrinsic spark safety. A human-body-equivalent electrostatic discharge between a pin and the electrically-isolated housing of the detonator is sufficient to ignite the energetic material and yield a detonation output.

As a result, such detonators lack intrinsic electrostatic discharge protection and so external design features such as spark gaps, varistors, or electrostatic shunt mixes must be incorporated. In addition, CP and primary explosives readily autoignite. Consequently, detonators that contain these materials commonly yield detonation output when heated rapidly, as in a bonfire scenario.

Various attempts have been made to develop a spark-safe, low-voltage detonator by loading the detonator with an organic, secondary explosive, such as PETN (pentaerythritol tetranitrate), HMX (cyclotetramethylenetetranitramine), or RDX (cyclotrimethylene trinitramine). Such materials should provide intrinsic electrostatic discharge protection.

However, detonators using such materials have proved to be unreliable. Unlike CP, these powders frequently decouple from the bridgewire, resulting in ignition failure. Further, detonators that contain HMX, RDX, PETN, or other secondary explosives are prone to ignition and growth-to-detonation failures because powder confinement is a critical and sensitive parameter.

Studies have shown that mechanical confinement of the powder is necessary to prevent the decoupling that occurs with increasing time or thermal cycling. Elimination of the decoupling by mechanical means has not been proven to date. In addition, growth-to-detonation in such devices is sensitive to physical characteristics of the powder (particle size, surface area) and occurs more gradually than in CP detonators. As a result, reliability of growth-to-detonation is diminished.

Consequently, a need exists for a fresh approach to providing a spark-safe and bonfire-safe, low-voltage detonator that will avoid the above-described problems associated with previous attempts.

SUMMARY OF THE INVENTION

The present invention provides a spark-safe low-voltage detonator designed to satisfy the aforementioned needs. The invention of the patent application cross-referenced above provides a bonfire-safe low-voltage detonator. The compositions of the spark-safe detonator disclosed herein and of the bonfire-safe detonator disclosed in the cross-referenced application are useful separately from one another. On the other hand, it should be understood that they can also be incorporated into one detonator where the benefits of both spark and bonfire safety are desired.

The detonator of the present invention incorporates the advantages of CP and organic secondary explosives, while eliminating their respective disadvantages, to yield a reliable, low-voltage detonator with intrinsic electrostatic-discharge, or spark, protection. Particularly, a thin layer (or pad) of an organic secondary explosive, such as HMX, loads the ignition region of the detonator adjacent to the electrical ignition device, i.e., the bridgewire. CP loaded under high pressure fills the remainder of the ignition region, whereas CP under low pressure loads the deflagration-to-detonation transition (DDT) column of the detonator. The pad of the organic secondary explosive provides spark protection between the pins and the housing. The remaining high-pressure ignition region CP provides mechanical confinement of the pad to prevent bridgewire decoupling.

Accordingly, the present invention is set forth in a detonator having a housing with an bore therein and a header supported by the housing and mounting an electrical ignition device in communication with and adjacent an end of the housing bore. The present invention relates to a column of explosive comprising: (a) an organic secondary explosive charge in the form of a thin pad disposed in the housing bore in an ignition region of the explosive column adjacent to the ignition device; (b) a first explosive charge of CP disposed in the housing bore in the ignition region of the explosive column and on a side of the secondary explosive charge opposite from the ignition device, the first CP charge being loaded under sufficient pressure adjacent to and in physical contact with the pad of secondary explosive charge to provide mechanical confinement of the thin pad and physical coupling thereof with the ignition device in a manner sufficient to prevent decoupling of the pad from the ignition device; and (c) a second explosive charge of CP disposed in the housing bore in a transition region of the explosive column and on a side of the first CP charge opposite from the secondary explosive charge, the second CP charge being loaded under sufficient pressure adjacent to and in physical contact with the first CP charge to allow occurrence of deflagration-to-detonation transition (DDT).

More particularly, the secondary explosive charge is HMX, preferably fine particle Type 2. Also, the secondary explosive charge and first CP charge have respective axial thicknesses within the range of twenty to thirty percent of its diameter.

Further, the first explosive charge of CP is loaded under a pressure of from 25 to 40 kpsi, whereas the second explosive charge of CP is loaded under a pressure of about 10 kpsi. The second explosive charge of CP is loaded in increments having an axial length-to-diameter ratio of one to two.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 2:
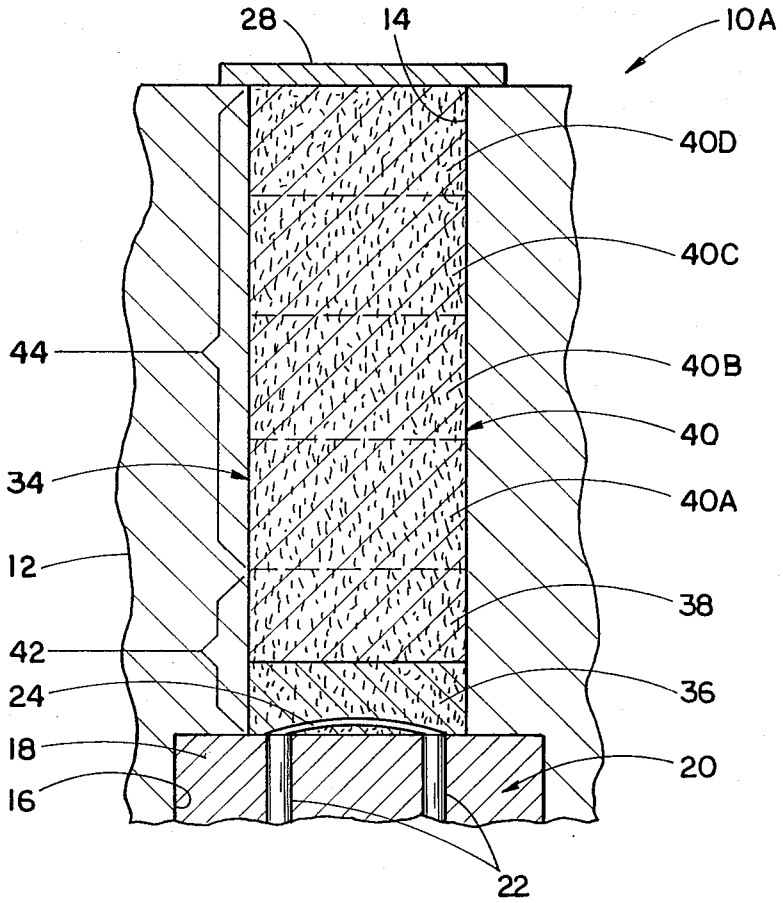
FIG. 2 is an enlarged fragmentary schematic axial sectional view of a spark-safe low-voltage detonator constructed in accordance with the principles of the present invention.

In the following description, like reference characters designate like or corresponding parts throughout the several views. Also in the following description, it is to be understood that such terms as "forward?, "rearward", "left", "right", "upper", "lower", and the like, are words of convenience and are not to be construed as limiting terms.

Prior Art Detonator

Figure 1:
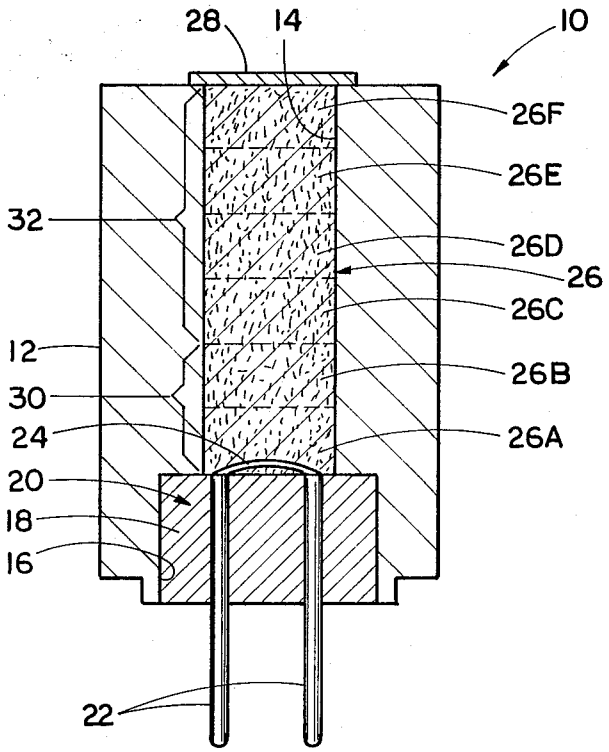
FIG. 1 (PRIOR ART)
FIG. 1 is a schematic axial sectional view of a standard prior art CP-loaded detonator.

Referring now to the drawings, and particularly to FIG. 1, there is schematically shown a standard prior art CP-loaded detonator, generally designated by the numeral 10. In its basic components, the detonator 10 includes a housing 12 having an axial cylindrical cavity or bore 14 open at both ends and a cylindrical recess 16 larger in diameter than and communicating with a lower end of the bore 14. The housing 12 is cylindrical in shape and composed of a suitable material such as steel.

The detonator 10 also includes a header 18 being cylindrical in shape and mounted to the housing 12 within the recess 16 at the lower end thereof. The header 18 is composed of suitable electrical insulative material and supports an electrical ignition device 20 in the form of a pair of spaced pins or electrodes 22. The electrodes 22 are exposed at their upper ends facing the housing bore 14 and project from the header 18 at their lower ends for connection to suitable electrical components (not shown) for activating the detonator. At their exposed upper ends, the electrodes are interconnected by a resistively-heated bridgewire 24.

The housing bore 14 is loaded with a column of explosive 26, namely a charge of CP, and after which it is closed at its upper end by a circular closure disc 28, suitably attached such as by welding to the housing upper end about the opening to the bore 14. The closure disc 28 is composed of steel material.

The explosive CP column 26 is commonly loaded into the housing bore 14 in a series of increments, being represented by the dashed lines, such that the length-to-diameter ratio of each increment is one-half. The two charge increments 26A and 26B closest to the resistive bridgewire 24, called the ignition region 30, are typically loaded at 25 to 40 kpsi, whereas the remainder of the charge increments 26C–26F, called the transition region 32, are loaded at 10 kpsi.

The higher loading pressure of the explosive column 26 in the ignition region 30 ensures powder-to-bridgewire contact and thereby promotes ignition reliability. The lower loading pressure of the explosive column 26 in the transition region 32 permits desired gas flow through the column and thereby promotes the desired deflagration-to-detonation transition (DDT). Reduced density of the powder in the transition region 32 resulting from low loading pressure is required to yield reliable DDT. Prior work has shown that increased loading pressure increases density, decreases gas permeability, and decreases the pore size distribution. The results imply that larger pores dominate gas flow processes leading to DDT.

While the detonator 10 having the above-described structure and explosive charge composition is highly reliable, spark protection in the form of an external spark gap or a pin-to-case electrical ground is required because compacted and contained CP is known to be spark sensitive. The present invention recognizes that improved safety against spark hazard can be attained by the specific selection and tailoring of the energetic materials making up the column of explosive 26.

Spark-Safe Low-Voltage Detonator

Turning now to FIG. 2, there is schematically shown the detonator portion which has been modified in accordance with the principles of the present invention in order to provide a reliable, low-voltage detonator 10A with intrinsic electrostatic-discharge, or spark, protection. The structural make-up of the detonator 10A is the same as the prior art detonator 10 and so the same reference numerals are used to identify identical parts.

It is the composition and layering of a column of explosive 34 in the low-voltage detonator 10A that renders it spark-safe and thus different from the prior art spark-sensitive low-voltage detonator 10. In its basic makeup, the composition of the column of explosive 34 in the low-voltage detonator 10A is selected and layered to include, within the bore 14 of the housing 12 of the detonator, an organic secondary explosive charge 36, such as HMX, preferably fine particle Type 2, in the form of a thin pad, and first and second explosive charges 38, 40 of CP.

More particularly, the pad of secondary charge 36 in the explosive column 34 is disposed in the housing bore 14 in the ignition region 42 of the explosive column 34 and in coupled relation adjacent to the bridgewire 24 of the ignition device 20 at the one end of the bore 14. If the HMX pad 36 is too thick, it may decouple from the bridgewire 24 or burn so slowly as to jeopardize the occurrence of DDT. If the pad 36 is too thin, it may fail to provide spark protection. Preferably, for optimum performance, the pad of secondary charge 36 has an axial thickness within a range of twenty to thirty percent of its diameter.

The first explosive CP charge 38 in the explosive column 34 is disposed in the housing bore 14 in the ignition region 42 of the explosive column 34 next to the secondary charge pad 36 on a side opposite from the ignition device 20. Because CP does not decouple from the housing 14 as a result of thermal cycling, the first CP charge 38 is loaded under sufficient pressure, for example within the range of 25 to 40 kpsi, to provide mechanical confinement of the pad of secondary charge 36 and physical coupling thereof with the ignition device 20, preventing decoupling of the secondary charge 36 therefrom.

The second explosive CP charge 40 in the explosive column 34 is disposed in the housing bore 14 in a transition region 44 of the explosive column 34 next to the first CP charge 38 on a side opposite from the pad of secondary charge 36. The second CP charge 40 is loaded under sufficient pressure, for example about 10 kpsi, to allow occurrence of DDT. The explosive CP charges 38,40 are loaded in increments 38 and 40A–40D. The low pressure increments 40A–40D preferably have an axial length-to-diameter ratio of approximately one-half. The high pressure increment 38 next to the secondary charge 36 has a ratio about the same as that of the secondary charge 36.

It is seen, therefore, that by provision of the thin pad 36 of HMX pressed against the bridgewire 24 and of the remainder of the explosive column being composed of charges 38, 40 of CP, the present invention takes advantage of the strengths, but minimizes the weaknesses, of both classes of explosive materials, HMX and CP. The HMX pad 36 provides spark protection between the bridgewire electrode 22 and the detonator housing 14. The CP charges 38, 40 serve to confine the HMX so that reliable ignition occurs and provides reliable growth to detonation.

Test Results

Investigations were done to assess HMX particle size, electrostatic discharge testing, thermal cycling, and test firing for ignition and output evaluation. In the investigations, a extensive matrix of measurements and tests were performed on conservatively designed detonators, i.e., detonators in which margins for ignition reliability and spark safety are deliberately reduced relative to those in a well-designed detonator. For example, the 0.0013 inch diameter bridgewire is considerably smaller than the size one would select to initiate HMX. In addition, an extremely small spark gap was employed, namely 0.018 inch on the outside and 0.025 inch inside. Two choices of HMX, representing extreme choices of particle size, were used. The Type I (coarse) and Type 2 (fine) HMX have Fisher sub-sieve surface areas of 900 and 16,000 $cm^2/gm$, respectively.

Three groups of detonators were loaded. One group (28 units) had a pad of Type I HMX, 0.035 +/−0.005 inch thick pressed at 40 kpsi against the bridgewire. That was followed by a 0.030 inch thick pad of CP pressed at 40 kpsi. The column was completed with four approximately equal increments of CP pressed at 10 kpsi —a total of 0.320 inch in length. A second group (28 units) incorporated Type 2, rather than Type 1, HMX and was loaded in an identical manner. The third group (7 units) consisted of all-CP detonators for comparison purposes. These detonators contained two increments (each 0.065 inch thick) loaded at 40 kpsi followed by four increments loaded at 10 kpsi.

The detonators were subjected to numerous electrostatic discharge (spark) tests and thermal cycling. Electrothermal response (ETR) measurements were made after each condition that could conceivably degrade the bridgewire-to-powder coupling. Such measurements yield gamma values which are a measure of heat transfer from the bridgewire to its environment. Bridgewire-to-powder decoupling has been shown previously to yield drastic reductions (>50%) in gamma. Final functional testing consisted of initiation testing under two different firing pulses, at temperature extremes, and two different types of output testing.

Initially, one unit containing each type of HMX was subjected to ETR measurements with 350, 450, and lastly 550 mA pulses through the bridgewire. The ETR data and subsequent post-mortems showed no evidence of powder degradation from such pulses. As a result, 500 mA was selected as the current to be used in further ETR testing. All units were then subjected to ETR characterization.

The HMX-containing units were then subjected to the human-body-equivalent electrostatic discharge (600 pF charged to 20 kV and discharged through a 500 ohm series resistor) from pin to detonator housing. Three devices containing Type 1 HMX fired. While 51 units did not fire, it was recognized that a false sense of security may have been achieved because nothing had been done to force the discharge to occur within the component, i.e., an external discharge could have occurred and that would reflect the existence of a spark gap rather than intrinsic safety. The seven all-CP units were then subjected to ESD testing. None fired and external discharges were observed in all cases. As a result, all further ESD testing was performed with the component immersed in a dielectric fluorinert liquid to diminish the possibility of external sparking. Two all-CP units were tested and both fired. This confirmed the view that the spark passing through CP would ignite it. The remaining 24 devices containing Type 1 HMX yielded no ignitions and no external sparks were observed. The 27 units containing Type 2 HMX yielded no ignitions; four units exhibited external arcing, indicating that the dielectric standoff of the fine HMX exceeded that of the fluorinert in these cases.

All units were then subjected to a second ETR measurement. Following that, all HMX-containing units were given ten successive ESD pulses to determine if ESD sensitivity increases with successive pulses. None fired. These units then received their third ETR measurement. Next, they were subjected to thermal cycling from −60 to +80 degrees C., three cycles, with a one hour minimum soak time at each temperature. The fourth ambient ETR measurement followed. To determine whether the thermal cycling affected ESD sensitivity, the units were subjected to ten more successive ESD pulses and again none fired. The fifth and final ETR measurement was performed. Variations in the gamma values after each test were normal data scatter. Final values differed from initial ones by < or = to 15% and no systematic shift occurred.

Units were then subjected to initiation and output testing. Two initiation conditions were assessed: (1) a battery-simulating, low-current, relatively long pulse, and (2) a capacitor-discharge-simulating high-current, relatively short pulse. The former was a four ampere pulse which was limited in time by burnout of the bridgewire. All units subjected to this pulse were tested at −54 degrees C. because this was considered to be a difficult initiation condition. Of the nine units containing Type 1 HMX tested, two failed to function. Of the ten devices containing Type 2 HMX tested, one failed to function. Both all-CP units tested functioned. Bridgewire burnout times for the HMX-containing devices was nominally 700 microseconds whereas for CP it was approximately 250 microseconds. Output from these tests was assessed from the dents generated in steel witness plates. For the Type 1 HMX, Type 2 HMX and all-CP units, the average dents were 0.0119, 0.142 and 0.0143 inch, respectively.

The other fire pulse provided approximately 50 amperes and bridgewire open-circuit generally occurred within 10 microseconds. The energy deposited in the bridgewire was typically 20–25 mJ for units containing either type of HMX and about half that amount for all−CP units. These values were not significantly affected by the choice of test fire temperature, −54 or +80 degrees C. Ten units containing Type 1 HMX were tested at the low temperature extreme. All fired with function times of 17–20 microseconds and flyer plate velocities (determined by VISAR) at 1 mm displacement were 2.4–2.8 mm/microsecond. Nine units containing Type 2 HMX were also tested at −54 degrees C. All fired with function times of 14–16 microseconds and flyer velocities were 2.5–2.7 mm/microsecond. While the function times achieved are longer than those achieved with CP due to the slower deflagration of HMX, the flyer velocities are comparable. Tests performed at +80 degrees C. yielded longer function times and VISAR data were frequently lost. Of the five units containing Type 1 HMX tested at the high temperature extreme, only one yielded velocity data. It had a velocity of 2.5 mm/microsecond at a displacement of 1 mm and its function time was 24.9 microseconds. The other four units functioned and the five bridgewire open times were 8.3–10.5 microseconds. Seven units containing Type 2 HMX were tested at +80 degrees C. All functioned with bridgewire open times of 8.2–10.1 microseconds. Velocity data were obtained for four units; velocities were 2.4–2.7 mm/microseconds and function times for these devices were 15.7–19.3 microseconds. Tests that did not yield velocity data had longer function times.

The results indicate that a reliable, spark-safe detonator can be achieved by pressing a thin pad of HMX against the bridgewire and loading CP on top of it. With a 0.035 inch thick pad of Type 2 HMX, no spark ignitions were encountered through the testing which included multiple discharge tests and thermal cycling. As far as bridgewire initiation testing, one unit failed to function from the four ampere pulse at −54 degrees C. while all functioned from the high-energy pulse at −54 and +80 degrees C. Output was comparable to an all−CP detonator. The optimum detonator would incorporate a larger bridgewire to improve ignition reliability. Fine particle HMX, such as Type 2, is definitely preferred over coarser material. The former improves ignition reliability, spark safety, and detonator output, relative to the latter. The important points of the present invention, however, are that this arrangement of materials forms a detonator in which intrinsic spark safety is achieved while ignition reliability and output can be retained.

Recapitulation

In summary, the present invention is based on the selection and use of layered explosives within the detonator. The desired safety advantage is derived from the intrinsic properties of the explosives themselves. This is a major difference from other detonators in which safety must be achieved through the use of auxiliary parts. No prior detonators are known which furnish improved safety through selection and layering of the explosive materials themselves. Since the present invention addresses safety within the powder column itself, provision of some external protective device is rendered unnecessary. The present invention yields a primary level of safety improvement, i.e., if the powder column is intrinsically safe, the detonator is inherently safe.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

I claim:

1. In a detonator having a housing with an bore therein and a header supported by said housing and mounting an electrical ignition device in communication with and adjacent to an end of said housing bore, a column of explosive comprising:

(a) a first layer of an organic secondary explosive charge disposed in said housing bore in an ignition region of said explosive column adjacent to said ignition device;

(b) a second layer of an explosive charge of CP disposed in said housing bore in said ignition region of said explosive column and on a side of said first layer opposite from said ignition device, said second layer being loaded under sufficient pressure adjacent to and in physical contact with said first layer to provide mechanical confinement of said first layer and physical coupling thereof with said ignition device in a manner sufficient to prevent decoupling of said first layer from said ignition device; and (c) a third layer of an explosive charge of CP disposed in said housing bore in a transition region of said explosive column and on a side of said second layer opposite from said first layer, said third layer being loaded under sufficient pressure adjacent to and in physical contact with said second layer to allow occurrence of deflagration-to-detonation transition (DDT).

2. The detonator as recited in claim 1, wherein said first layer of said secondary explosive charge is HMX.

3. The detonator as recited in claim 2, wherein said HMX is fine particle Type 2.

4. The detonator as recited in claim 1, wherein said first layer of said secondary explosive charge and second layer of CP charge have respective axial thicknesses within the range of twenty to thirty percent of its diameter.

5. The detonator as recited in claim 1, wherein said second layer is loaded under a pressure of from 25 to 40 kpsi.

6. The detonator as recited in claim 1, wherein said third layer is loaded under a pressure of about 10 kpsi.

7. The detonator as recited in claim 1, wherein said third layer is loaded in increments having an axial length-to-diameter ratio of one-half.

8. In a detonator having a housing with an bore therein and a header supported by said housing and mounting an electrical ignition device in communication with and adjacent to an end of said housing bore, a column of explosive comprising:

(a) an organic secondary explosive charge of HMX in the form of a thin pad disposed in said housing bore in an ignition region of said explosive column adjacent to said ignition device, said pad of secondary charge having an axial thickness within the range of twenty to thirty percent of its diameter;

(b) a first explosive charge of CP disposed in said housing bore in said ignition region of said explosive column and on a side of said secondary explosive charge opposite from said ignition device, said first CP charge being loaded under sufficient pressure adjacent to and in physical contact with said secondary explosive charge to provide mechanical confinement of said secondary charge and physical coupling thereof with said ignition device in a manner sufficient to prevent decoupling of said secondary charge from said ignition device; and (c) a second explosive charge of CP disposed in said housing bore in a transition region of said explosive column and on a side of said first CP charge opposite from said secondary charge, said second CP charge being loaded under sufficient pressure adjacent to and in physical contact with said first CP charge to allow occurrence of deflagration-to-detonation transition (DDT).

9. The detonator as recited in claim 8, wherein said HMX of said secondary charge layer is fine particle Type 2.

10. The detonator as recited in claim 8, wherein said first explosive charge of CP is loaded under a pressure of from 25 to 40 kpsi.

11. The detonator as recited in claim 8, wherein said second explosive charge of CP is loaded under a pressure of about 10 kpsi.

12. The detonator as recited in claim 8, wherein said first explosive charge of CP is loaded in an increment having an axial length-to-diameter ratio within the range of twenty to thirty percent.

13. The detonator as recited in claim 8, wherein said second explosive charge of CP is loaded in increments having an axial length-to-diameter ratio of one to two.

14. In a detonator having a housing with an bore therein and a header supported by said housing and mounting an electrical ignition device in communication with and adjacent an end of said housing bore, a column of explosive comprising:

(a) an organic secondary explosive charge of HMX in the form of a thin pad disposed in said housing bore in an ignition region of said explosive column adjacent to said ignition device, said pad of secondary charge having an axial thickness within the range of twenty to thirty percent of its diameter;

(b) a first explosive charge of CP disposed in said housing bore in said ignition region of said explosive column and on a side of said secondary explosive charge opposite from said ignition device, said first CP charge being loaded under sufficient pressure adjacent to and in physical contact with said secondary explosive charge to provide mechanical confinement of said secondary charge and physical coupling thereof with said ignition device in a manner sufficient to prevent decoupling of said secondary charge from said ignition device; and (c) a second explosive charge of CP disposed in said housing bore in a transition region of said explosive column and on a side of said first CP charge opposite from said secondary charge, said second CP charge being loaded under sufficient pressure adjacent to and in physical contact with said first CP charge to allow occurrence of deflagration-to-detonation transition (DDT);

(d) said first explosive charge of CP being loaded under a pressure of from 25 to 40 kpsi and said second explosive charge of CP being loaded under a pressure of about 10 kpsi, said first explosive charge of CP being loaded in an increment having an axial length-to-diameter ratio of 0.2 to 1 to 0.3 to 1 and said second explosive charge of CP being loaded in increments having an axial length-to-diameter ratio of one to two.

15. The detonator as recited in claim 14, wherein said HMX of said secondary charge is fine particle Type 2.

* * * * *